US005900392A

United States Patent [19]

Bernhard

[11] Patent Number: 5,900,392

[45] Date of Patent: May 4, 1999

[54] AQUEOUS BELT LUBRICANT COMPOSITION BASED ON FATTY ALKYL PROPYLENE TETTRAMINES AND FATTY ALCOHOL POLYGLYCOL ETHERS AND METHOD FOR LUBRICATING BELT CONVEYOR SYSTEMS

[75] Inventor: Laut Bernhard, Köln, Germany

[73] Assignee: Loeffler Chemical Corporation, Atlanta, Ga.

[21] Appl. No.: 09/122,096

[22] Filed: Jul. 24, 1998

[51] Int. Cl.[6] ..... C10M 173/00; C10M 141/02; C10M 141/06

[52] U.S. Cl. ..... 508/154; 508/156; 508/162; 508/179; 508/506; 508/518; 508/520; 508/521; 508/532; 508/556

[58] Field of Search ..... 508/154, 156, 508/162, 179, 506, 518, 520, 521, 532, 556

[56] References Cited

U.S. PATENT DOCUMENTS

| | | | |
|---|---|---|---|
| 4,521,321 | 6/1985 | Anderson et al. . | |
| 4,604,720 | 8/1986 | Stikvoort | 364/724 |
| 4,839,067 | 6/1989 | Jansen . | |
| 5,062,978 | 11/1991 | Weber et al. . | |
| 5,182,035 | 1/1993 | Schmidt et al. . | |

FOREIGN PATENT DOCUMENTS

| | | |
|---|---|---|
| 372628 | 6/1990 | European Pat. Off. . |
| WO 5389/6 | 4/1993 | European Pat. Off. . |

*Primary Examiner*—Jacqueline V. Howard
*Attorney, Agent, or Firm*—Keil & Weinkauf

[57] ABSTRACT

An aqueous belt lubricant composition comprising water and from 1.0 to 10 wt % of at least a fatty alkyl propylene tetramine, from 1.0 to 10 wt % of at least a fatty alcohol polygylcol ether, all percentages are based on the total weight of the aqueous belt lubricant composition, and at least one acid in an amount sufficient to establish a pH value between about 5.0 and about 7.0. The composition may further comprising one or more of alkoxylated fatty alkyl monoamines, alkoxylated fatty alkyl diamines and/or a solutizer.

15 Claims, No Drawings

AQUEOUS BELT LUBRICANT COMPOSITION BASED ON FATTY ALKYL PROPYLENE TETTRAMINES AND FATTY ALCOHOL POLYGLYCOL ETHERS AND METHOD FOR LUBRICATING BELT CONVEYOR SYSTEMS

The present invention relates to aqueous fatty alkyl polyamine and fatty alcohol polyglycol ether containing lubricant compositions and, more particularly, their use as conveyor belt lubricants for the lubrication of conveyor belt systems for beverage containers.

PRIOR ART

Lubricants are employed in applications in which good gliding contact between solid surfaces, for instance, glass and metal, need to be ensured, for example in glass bottle filling and conveying plants, where they are applied to the conveyor belts to ensure the conveyance of bottles on the conveyor belt. When used as such, the lubricants may be referred to as belt lubricants.

Belt lubricants including certain amine compounds have been described, for example, in U.S. Pat. Nos. 4,839,067; 4,521,321; 4,604,720, and European patent application no. 372 628. These known synthetic belt lubricants are generally an improvement over the already known use of soaps as lubricants; however, they still tend to form poorly soluble precipitates which manifests itself in the clouding of the lubricant solution. Since the precipitates formed can cause breakdowns as a result of deposits in blind zones or clogging of nozzles of the dispensing system, they must be removed regularly by frequent cleaning of the systems. Due to more frequent cleaning, the known lubricant compositions do not satisfy the requirements of a continuous operation of the conveyor belts.

It is the object of the present invention to provide an improved aqueous belt lubricant composition which increases the periods between breakdowns for removing precipitates by cleaning the plant.

It is a further object of the present invention to formulate an aqueous belt lubricant composition providing exceptional lubrication at high dilution ratios.

It is another object of the present invention to provide a belt lubricant composition having self-cleaning characteristics. Another object of the invention refers to a method for lubricating belt conveyor systems to ensure a continuous operation of the plant.

SUMMARY OF THE INVENTION

Surprisingly, it has now been found that these objects are attained by an aqueous belt lubricant composition containing a particular group of fatty alkyl polyamines exhibiting substantially improved gliding behavior at high dilution ratios and does not easily form precipitates resulting in breakdowns for more frequent cleaning of the plant. The aqueous belt lubricant composition according to the present invention contains, as a further essential component, a fatty alcohol polyglycol ether.

The belt lubricant composition according to the present invention can be used on stainless steel and plastic conveyors and produces excellent lubrication when used with one-piece PET containers, glass bottles, aluminum cans, and most other common beverage and food containers. These compositions provide the following advantages:

Unaffected by water hardness, carbon dioxide and by presence of sulfates; clean conveyor belts during normal operation; contaminated conveyor belts will be cleaned during operation; highly anti-microbial and eliminate the need for sanitizers or microbiocides, prevent slime build-up on conveyors, environmentally sound and biodegradable.

DETAILED DESCRIPTION OF THE INVENTION

The aqueous belt lubricant composition is formulated as a dilutable concentrate comprising water and from 1.0 to 20 wt % of at least one fatty alkyl propylene tetramine, from 1.0 to 10 wt % of at least a fatty alcohol polyglycol ether and at least one acid in an amount sufficient to establish a pH value between about 5 and about 7.

All percentages specified above and below are based on the total weight of the aqueous belt lubricant composition.

The concentration of at least one acid may be from about 1% to about 15% by weight, preferably from about 2% to about 10% by weight.

The acids may improve the solubility of the fatty alkyl polyamines by forming salts with the amines.

Inorganic acids as well as organic acids can be used to adjust the pH value. Organic acids being given preference over inorganic acids because of their more favorable solubility. However, combinations of inorganic acids and organic acids may be used if desired.

Useful inorganic acids include hydrochloric acid, boric acid, phosphoric acids, and mixtures thereof.

Useful organic acids include formic acid, acetic acid, propionic acid, 2,2-methyl propionic acid, 2-ethyl-propionic acid, lactic acid, D-gluconic acid, tartaric acid, citric acid, benzoic acid, salicylic acid, succinic acid, monohydroxysuccinic acid, and mixtures thereof.

With reference to the fatty alkyl propylene tetramine a concentration of at least one fatty alkyl propylene tetramine of from about 5% by weight to about 10% by weight is preferred.

The fatty alkyl group of said tetramines has from 6 to 22 carbon atoms, preferably from 8 to 20 carbon atoms.

Examples for useful polyamines are tallow propylene tetramine, cocopropylene tetramine, oleyl propylene tetramine, $C_{16}$–$C_{22}$ alkyl propylenetetramine, oleyl (vegetable oil)propylene tetramine, capryl propylene tetramine, lauryl propylene tetramine, cetyl propylen tetramine, stearyl propylene tetramine, 2-hexyldecanyl propylene tetramine, 2-heptylundecanyl propylene tetramine, linoleyl propylene tetramine, or mixtures thereof.

The coco alkyl group contains alkyl groups having a chain length from 8 to 18 carbon atoms, for example 5% $C_8$, 6% $C_{10}$, 50% $C_{12}$, 19% $C_{14}$, 10% $C_{16}$, and 10% $C_{18}$.

The tallow alkyl group contains alkyl groups having a chain length from 12 to 18 carbon atoms, for example 1% $C_{12}$, 4% $C_{14}$, 31% $C_{16}$, and 64% $C_{18}$.

The oleyl (vegetable oil) alkyl groups having a chain length from 16 to 20 carbon atoms, for example 8% $C_{16}$, 90% $C_{18}$, and 2% $C_{20}$.

The oleyl alkyl groups contains alkyl groups having a chain length from 12 to 18 carbon atoms, for example 1% $C_{12}$, 4% $C_{14}$, 12% $C_{16}$, and 82% $C_{18}$.

The $C_{16-22}$ alkyl group contains alkyl groups having a chain length from 16 to 22 carbon atoms, for example 12% $C_{16}$, 26% $C_{18}$, 32% $C_{20}$, and 30% $C_{22}$.

The particular fatty alkyl propylene tetramines may be present in the composition as a single compound or a mixture of one or more of the compounds specified above. Preferably one or two of the compounds are used for the belt lubricant composition according to the present invention.

These polyamines in general have a density at 60° C. of about 0.85 grams/cm$^3$; the melting point is in the range from 25° C. to about 70° C., preferably from about 35° C. to about 55° C. These polyamines are commercially available, for example from Akzo Nobel Chemicals Inc.

The second essential component of the belt lubricant composition of the present invention is a nonionic tenside of the fatty alcohol polyglycol ether type, which is acting as an antifoaming agent.

The alkyl group of the fatty alcohol used to form the alcohol polyglycol ether contains 6 to 22 carbon atoms, such as hexyl, octyl, decanyl, undecanyl, lauryl, cetyl, stearyl, hexadecanyl, heptyl undecanyl, octyl dodecanyl, 2-nonyltridecanyl, oleyl, linoleyl, tallowyl, $C_{16}$–$C_{22}$ alkyl, coco alkyl group.

The chain length distribution of the alkyl group may be similar to the distribution as specified for the alkyl group of the fatty alkyl propylene tetramines.

Most preferred are $C_{12}$–$C_{14}$or $C_{16}$–$C_{18}$ alkyl groups.

The content of ethoxy and/or propoxy and/or buthoxy units may be from 2 to 40 moles ethoxy/mol and/or moles propoxy/mol and/or buthoxy/mol of the fatty alcohol polyglycol ether, preferably from 2 to 25 moles ethoxy and/or propoxy and/or buthoxy/mol.

Most preferred are 2 to 5 moles ethoxy/mol and 4 to 6 moles propoxy/mol.

If desired the reactive end groups of the compounds may be capped to block undue reactions of such and to increase the chemical stability of the compounds.

The compounds are liquids having specific densities between 0.9 and 1.1 grams/cm$^3$ and the gel point is from −35° C. to +10° C. Aqueous solutions containing 5% by weight have in general a pH-value of about 7.

These fatty alcohol polyglycol ethers are commercially available from a plurality of suppliers such as BASF, Akzo Nobel Chemicals Inc.

The concentration of the at least one fatty alcohol polyglycol ether in the composition according to the present invention is from about 1 to 10 weight percent, preferably from about 2 wt % to 8 wt %, based on the total weight of the aqueous lubricant composition.

The particular fatty alcohol polyglycol ethers may be present in the composition as a single compound or a mixture of one or more of the compounds specified above. Preferably one compound is present in the belt lubricant composition according to the present invention.

In general, it is possible but not preferred to include into the lubricant composition according to the invention, besides the two essential components, additional amine components such as fatty alkyl monoamines or fatty alkyl diamines.

Fatty alkyl monoamines are compounds of the formula

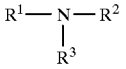

wherein $R^1$ is a saturated or unsaturated, branched or linear alkyl group having 8 to 22 carbon atoms, $R^2$ is hydrogen, an alkyl group or hydroxyalkyl group having 1 to 4 carbon atoms and $R^3$ is equal to $R^1$ or $R^2$.

Examples of such fatty alkyl monoamines are hexadecyl/dimethyl amine, octadecyl dimethyl amine, coco dimethyl amine, tallow dimethyl amine, oleyl dimethyl amine, dicoco methyl amine, ditallow methyl amine, oleyl amine, coco amine, lauryl amine, and the like.

Fatty alkyl diamines are compounds of the formula

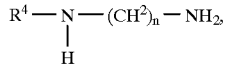

wherein $R^4$ is a saturated or unsaturated, branched or linear alkyl group having 8 to 22 carbon atoms and n is an integer from 2 to 6.

Examples of such fatty alkyl diamines are coco propylen diamine, tallow propylene diamine, $C_{16-22}$ alkyl propylene diamine, oleyl propylene diamine, coco ethylene diamine, tallow ethylene diamine, oleyl ethylene diamine, $C_{16-22}$ alkyl ethylene diamine and the like.

These fatty alkyl monoamines, diamines or mixtures of each and combinations thereof may be present in amounts from 0 to about 20 wt %, preferably from 0 to about 10 wt %, more preferably from about 2 to about 5 wt %, based on the total weight of the belt lubricant composition.

As further constituents of the belt lubricant composition according to the present invention, dissolving agents and/or dispersing agents may be present to assist dilution with water without precipitation or clouding.

Dispersing agents may be added to the belt lubricant composition generally in amounts ranging from 0 to about 5 wt %, preferably from 0 to about 2 wt %, more preferred from 0 to about 0.5 wt %, based upon the total weight of the aqueous belt lubricant composition.

Examples of suitable dispersing agents are triethanol amine and alkoxylated fatty alkyl monoamines and alkoxylated fatty alkyl diamines of the formulas

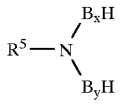

and

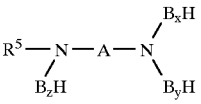

wherein $R^5$ is a linear or branched, saturated or unsaturated alkyl group having 8 to 22 carbon atoms, A is a linear or branched alkylene group having 1 to 8 carbon atoms and B represents ethoxy or propoxy groups which may be the same or different in each of the above formulas and the sum x and y and optionally z is a number in the range of 2 to 200.

Examples of such compounds are coco bis(2-hydroxyethyl)amine, polyoxyethylene(5)coco amine, polyoxyethylene(15)coco amine, tallow bis(2-hydroxyethyl)amine, polyoxyethylene(5)tallow amine, tallow/oleyl bis(2-hydroxyethyl)amine, oleyl bis(2-hydroxyethyl)amine, polyoxyethylene(5)oleyl amine, polyoxyethylene(15)oleyl amine, tallow bis(2-hydroxyethyl)amine (hydrogenated), polyoxyethylene(5) tallow amine (hydrogenated), polyoxyethylene(15)tallow amine (hydrogenated), polyoxyethylene(50)tallow amine (hydrogenated), N,N',N'-tris(2-hydroxyethyl)N-tallow-1,3-diaminepropane, N,N',N'-polyoxyethylene(10)-N-tallow-1,3-diaminopropane, N,N',N'-polyoxyethylene(15)-N-tallow-1,3-diaminopropane, and polyoxyethylene(15)tallow amine.

The coco alkyl group, tallow alkyl group, oleyl alkyl group may have chains with different chain lengths as specified for these groups above.

Dissolving agents or solutizers are generally used in amounts ranging from 0 to about 20 wt %, preferably from 0 to about 10 wt %, based upon the total weight of the aqueous belt lubricant composition.

Particular examples of suitable solutizers are ethanol, isopropanol, benzylalcohol, ethylene glycol, 1,2-propylene glycol, butylene glycol, trimethylene glycol, polyethylene glycols, and polypropylene glycols having molecular weights from about 200 to about 4,000 and blockcopolymers thereof having a molecular weight of the hydrophobic polypropylene glycol portion from about 1,000 to about 4,000 and about 10 to about 80% hydrophilic polyethylene glycol portion having a molecular weight from about 2,000 to about 6,000, nonylphenol polyethylene glycol ether.

The dissolving agents can be used in mixtures to provide storage stable, excellent dilutable concentrates of the compositions according to the present invention.

The aqueous belt lubricant compositions according to the invention are preferably prepared as a concentrate and diluted to its end concentration prior to use.

Such a concentrate contains from 75 wt. % to 90 wt. %, preferably from 80 wt. % to 85 wt. % water.

As a result of the superior dilutability with water of any kind, dilution weight ratios concentrate:water from 1:about 200 to 1:about 1,500 are possible, preferably from 1:about 250 to 1:about 1,200.

The final use concentration of the belt lubricant composition is dependent upon one or more of the following factors:

Conveyor type, conveyor load, conveyor sped, product spillage on conveyors, dispensing system.

The following ranges of dilution ratios for common beverage containers are:

30 PET bottles 1:about 250 to 1:about 600 glass bottles 1:about 300 to 1:about 1,000 aluminum cans 1:about 400 to 1:about 1,200

Higher dilution ratios may be possible on certain systems, while other systems may require higher use concentrations.

The aqueous belt lubricant compositions in accordance with the present invention find particular use in bottle conveying processes, in which a conveyor belt is lubricated with a lubricating amount of the aqueous belt lubricant composition, which is preferably diluted prior to use. Such bottle conveying processes and apparatus utilized therein are well-known prior art, for example by the disclosure of U.S. Pat. No. 4,839,067 which content is included herewith by reference.

Accordingly, the solution of the object of the invention includes a method of lubricating conveyor belts by applying a lubricating amount of the belt lubricant composition according to the present invention and described before as a concentrate or diluted with water or an appropriate liquid diluent.

The composition can be used for stainless steel and plastic conveyor belt systems in conjunction with automated dispensing systems. All conveyors should operate for approximately 3 to 5 minutes subsequent to actuating the lubricant dispensing system to ensure complete distribution of the aqueous belt lubricant composition.

The following examples are offered by way of illustration of the invention and should not be considered as a limitation.

EXAMPLE 1

The following components are dissolved/dispersed in 80 kg deionized water by stirring to form a belt lubricant composition concentrate:

5 kg aqueous citric solution (acid content 50% by weight), 7 kg oleyl(vegetable oil)propylene tetramine, 4 kg liquid fatty alcohol polyglycol ether, $C_{12}$–$C_{18}$-ethoxy/propoxylate without capped end groups, viscosity at 25° C. 45 mPas (Plurafac LF403, BASF), 2 kg liquid fatty alcohol propoxylate, viscosity at 20° C. 70 mPas (Degressal SD20, BASF).

The aqueous belt lubricant concentrate has a pH value of about 5.8. It is dilutable with water in weight ratios concentrate:water from 1:about 250 to 1:about 1,200, depending upon the particular application to a belt conveyor.

EXAMPLE 2

The following components are dissolved/dispersed in 80 kg deionized water by stirring to form a belt lubricant composition concentrate:

5 kg aqueous citric acid solution (acid content 50% by weight), 7 kg tallow propylene tetramine, 5 kg liquid fatty alcohol polyglycol ether, $C_{12}$–$C_{18}$-ethoxy/propoxylate without capped end groups, viscosity at 25° C. 45 mPas (Plurafac LF403, BASF), 2 kg liquid fatty alcohol propoxylate, viscosity at 20° C. 70 mpas, (Degressal SD 20, BASF).

The aqueous belt lubricant concentrate has a period value of about 6.0. It is dilutable with water in weight ratios concentrate:water from 1:about 200 to 1:about 1,500, depending upon the particular application to a belt conveyor.

EXAMPLE 3

The following components are dissolved/dispersed in 80 kg deionized water by stirring to form a belt lubricant composition concentrate:

5 kg acetic acid (acid content 60% by weight), 7 kg coco propylene tetramine, 5 kg liquid fatty alcohol polyglycol ether, $C_{12}$–$C_{18}$-ethoxy/propoxylate without capped end groups, viscosity at 25° C. 45 mPas (Plurafac LF403, BASF), 2 kg liquid fatty alcohol polyglycol ether (propoxylated), viscosity at 20° C. 70 mPas, (Degressal SD 20, BASF).

EXAMPLE 4

The following components are dissolved/dispersed in 80 kg deionized water by stirring to form a belt lubricant composition concentrate:

5 kg acetic acid (acid content 60% by weight), 3 kg coco propylene tetramine, 2 kg tallow propylene tetramine, 4 kg liquid fatty alcohol polyglycol ether, $C_{12}$–$C_{18}$-ethoxy/propoxylate without capped end groups, viscosity at 25° C. 45 mPas (Plurafac LF403, BASF), 4 kg tallow aminoxethylate, having 15 moles ethoxy/mole, viscosity at 50° C. 55 mPas, (GENAMIN T150), 2 kg liquid fatty alcohol polyglycol ether (propoxylated), viscosity at 20° C. 70 mPas, (Degressal SD 20, BASF).

The aqueous belt lubricant concentrate has a pH value of about 5.4. It is dilutable with water in weight ratios concentrate:water from 1:about 250 to 1:about 1,200, depending upon the particular application to a belt conveyor.

EXAMPLE 5

The following components are dissolved/dispersed in 80 kg deionized water by stirring to form a belt lubricant composition concentrate:

5 kg acetic acid (acid content 60% by weight), 3 kg coco propylene tetramine, 4 kg oleyl (vegetable oil) propylene tetramine, 5 kg liquid fatty alcohol polyglycol ether, $C_{12}$–$C_{18}$-ethoxy/propoxylate without capped end groups, viscosity at 25° C. 45 mPas, (Plurafac LF403, BASF), 4 kg tallow aminoxethylate, 15 mole ethoxy/mole, viscosity at 50° C. 55 mPas, (GENAMIN T150), 2 kg liquid fatty alcohol polyglycol ether (propoxylated), viscosity at 20° C. 70 mPas, (Degressal SD 20, BASF).

The aqueous belt lubricant concentrate has pH value of about 5.8. It is dilutable with water in weight ratios concentrate:water from 1:about 250 to 1:about 1,200, depending upon the particular application to a belt conveyor.

EXAMPLE 6

The following components are dissolved/dispersed in 80 kg deionized water by stirring to form a belt lubricant composition concentrate:

5 kg aqueous gluconic acid solution (acid content 60% by weight), 3 kg tallow propylene tetramine, 4 kg oleyl (vegetable oil) propylene tetramine 5 kg liquid fatty alcohol polyglycol ether, $C_{12}$–$C_{18}$-ethoxy/propoxylate without capped end groups, viscosity at 25° C. 45 mPas (Plurafac LF403, BASF), 4 kg tallow aminoxethylate, 10 moles ethoxy/mol, viscosity at 50° C. 55 mPas, (GENAMIN T150), 2 kg liquid fatty alcohol polyglycol ether (propoxylated), viscosity at 20° C. 70 mPas, (Degressal SD 20, BASF).

EXAMPLE 7

The following components are dissolved/dispersed in 80 kg deionized water by stirring to form a belt lubricant composition concentrate:

5.0 kg acetic acid (acid content 60% by weight), 3.0 kg tallow propylene tetramine (AMIN 640), 3.0 kg fatty alcohol polyethyleneglycol ether, ($C_{16}$–$C_{18}$ alkyl mit 25 EO),(Lutensol AT 25, BASF)

0.3 kg nonionic surfactant, fatty alcohol polyglycol ether, (MACOL LF 111, PPG Ind. Inc.)

The aqueous belt lubricant concentrate has a pH value of about 6.0. It is dilutable with water in weight ratios concentrate:water from 1:about 200 to 1:about 1,500, depending upon the particular application to a belt conveyor.

I claim:

1. An aqueous belt lubricant composition comprising water and from 1.0 to 10 wt % of at least a fatty alkyl propylene tetramine, from 1.0 to 10 wt % of at least a fatty alcohol polygylcol ether, all percentages are based on the total weight of the aqueous belt lubricant composition, and at least one acid in an amount sufficient to establish a pH value between about 5.0 and about 7.0.

2. The aqueous belt lubricant composition of claim 1, wherein the at least one acid to establish a pH value between about 5 and about 7 is an inorganic acid, an organic acid, or a combination thereof and is present in an amount ranging from about 1% to 15% by weight, preferably from about 2% to about 10% by weight, based on the total weight of the aqueous belt lubricant composition.

3. The aqueous belt lubricant composition of claim 2, wherein the at least one acid is an inorganic acid selected from hydrochloric acid, boric acid, phosphoric acids and mixtures thereof.

4. The lubricant composition of claim 2, wherein the at least one acid is an organic acid selected from formic acid, acetic acid, propionic acid, 2,2-dimethyl propionic acid, 2-ethyl-propionic acid, lactic acid, D-gluconic acid, tartaric acid, citric acid, benzoic acid, salicylic acid, succinic acid, monohydroxy succinic acid, and mixtures thereof.

5. The aqueous belt lubricant composition of claim 1, wherein said at least one fatty alkyl propylene tetramine is selected from tallow propylene tetramine, cocopropylene tetramine, oleyl propylene tetramine, $C_{16-22}$ alkyl propylene tetramine, oleyl (vegetable oil) propylene tetramine, capryl propylene tetramine, lauryl proyplene tetramine, cetyl propylene tetramine, stearyl proypylene tetramine, 2-hexyl decanyl propylene tetramine, 2-heptyl-undecyl propylene tetramine, linoleyl propylene tetramine, or mixtures thereof.

6. The aqueous belt lubricant composition of claim 1, wherein the alkyl group of the fatty alcohol of said at least one fatty alcohol polyglycol ether contains 6 to 22 carbon atoms and the content of ethyloxy and/or propoxy units is from 2 to 40 moles ethoxy/mol and/or propoxy/mol and/or buthoxy/mol fatty alcohol polyglycol ether.

7. The aqueous belt lubricant composition of claim 6, wherein the fatty alcohol polyglycol ether is selected from capped or non capped $C_{12}$–$C_{14}$ fatty alcohol polyalkyl ethers comprising 2 to 5 moles ethoxy/mol, $C_{12}$–$C_{14}$ fatty alcohol polyalkyl ether comprising 4 to 6 moles propoxy/mol, $C_{12}$–$C_{14}$ fatty alcohol polyalkyl ethers comprising 2 to 5 moles ethoxy/mol and 4 to 6 moles propoxy/mol, $C_{16}$–$C_{18}$ fatty alcohol polyalkyl ethers comprising 4 to 25 moles ethoxy or propoxy or buthoxy/mol fatty alcohol polyglykolether.

8. The aqueous belt lubricant composition of claim 1 further comprising one or more of alkoxylated fatty alkyl monoamines, alkoxylated fatty alkyl diamines.

9. The aqueous belt lubricant composition of claim 8, wherein the alkoxylated fatty alkyl monoamine is selected from coco bis(2-hydroxyethyl)amine, tallow bis(2-hydroxyethyl)amine, tallow/oleyl bis(2-hydroxyethyl) amine, oleyl bis(2-hydroxyethyl)amine, tallow bis(2-hydroxyethyl)amine (hydrogenated), polyoxyethylene(5) coco amine, polyoxyethylene(15) coco amine, polyoxyethylene(5)tallow amine, polyoxyethylene(15) tallow amine, polyoxyethylene(5)oleyl amine, polyoxyethylene(15) oleyl amine, polyoxyethylene(5)tallow amine (hydrogenated), polyoxyethylene(15)tallow amine (hydrogenated), polyoxyethylene(50)tallow amine (hydrogenated), and mixtures thereof.

10. The aqueous belt lubricant composition of claim 8, wherein the alkoxylated fatty alkyl diamine is selected from N,N',N'-tris(2-hydroxyethyl)N-tallow-1,3-diaminopropane, N,N',N'-polyoxyethylene(10)N-tallow-1,3-diaminopropane, N,N',N'-polyoxyethylene(15)N-tallow-1,3-diaminopropane, and mixtures thereof.

11. The aqueous belt lubricant composition of claim 1 further comprising a solutizer compound.

12. The aqueous belt lubricant composition of claim 11, wherein said solutizer compound is present in an amount ranging from 0 to about 20 wt % based on the total weight of the aqueous belt lubricant composition.

13. The aqueous belt lubricant composition of claim 8, wherein one or more alkoxylated fatty alkyl monoamines, alkoxylated fatty alkyl diamines, are present in an amount ranging from 0 to about 5 wt % based on the total weight of the aqueous belt lubricant composition.

14. The aqueous belt lubricant composition comprising water and from 1.0 to 20 wt % of at least a fatty alkoxypropylene tetramine, selected from tallow propylene tetramine, cocopropylene tetramine, oleyl propylene tetramine, $C_{16-22}$ alkyl propylene tetramine, oleyl (vegetable oil) propylene tetramine, capryl propylene tetramine, lauryl propylene tetramine, cetyl propylene tetramine, stearyl propylene tetramine, 2-hexyl decanyl propylene tetramine, 2-heptyl-undecyl propylene tetramine, linoleyl propylene tetramine, or mixtures thereof and, from 1.0 to 10 wt % of at least a fatty alcohol polyglycol ether selected from capped or non capped $C_{12}$–$C_{14}$ fatty alcohol polyalkyl ethers comprising 2 to 5 moles ethoxy/mol, $C_{12}$–$C_{14}$ fatty alcohol polyalkyl ether comprising 4 to 6 moles propoxy/mol, $C_{12}$-$Cl_4$ fatty alcohol polyalkyl ethers comprising 2 to 5 moles ethoxy/mol and 4 to 6 moles propoxy/mol, $C_{16}$–$C_{18}$ fatty alcohol polyalkyl ethers comprising 4 to 12 moles ethoxy or propoxy or buthoxy/mol fatty alcohol polyglykolether.

15. A method of lubricating one or more conveyor belt of a conveyor belt system for beverage containers by diluting a concentrate aqueous belt lubricant composition comprising water and from 1.0 to 10 wt % of at least a fatty alkyl propylene tetramine, from 1.0 to 10 wt % of at least a fatty alcohol polygylcol ether, all percentages are based on the total weight of the aqueous belt lubricant composition, and at least one acid in an amount sufficient to establish a pH value between about 5.0 and about 7.0. with water in a weight ratio concentrate:water from 1:200 to 1:1,500 and applying said diluted composition to the conveyor belt.

* * * * *